US009111679B2

(12) United States Patent
Miyamoto et al.

(10) Patent No.: US 9,111,679 B2
(45) Date of Patent: Aug. 18, 2015

(54) METHOD PRODUCING RARE EARTH MAGNET

(75) Inventors: Noritaka Miyamoto, Toyota (JP); Akira Manabe, Toyota (JP); Tetsuya Shoji, Toyota (JP); Daisuke Ichigozaki, Nagoya (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 14/000,459

(22) PCT Filed: Feb. 22, 2012

(86) PCT No.: PCT/IB2012/000321
§ 371 (c)(1),
(2), (4) Date: Aug. 20, 2013

(87) PCT Pub. No.: WO2012/114192
PCT Pub. Date: Aug. 30, 2012

(65) Prior Publication Data

US 2013/0321112 A1 Dec. 5, 2013

(30) Foreign Application Priority Data

Feb. 23, 2011 (JP) ..... 2011-037320

(51) Int. Cl.
*H01F 7/02* (2006.01)
*H01F 41/02* (2006.01)
(Continued)

(52) U.S. Cl.
CPC ..... *H01F 41/0253* (2013.01); *B22F 3/14* (2013.01); *C22C 1/00* (2013.01); *C22C 38/002* (2013.01); *C22C 38/005* (2013.01); *C22C 38/10* (2013.01); *H01F 1/0576* (2013.01); *H01F 7/02* (2013.01); *H01F 41/0266* (2013.01); *C22C 2202/02* (2013.01)

(58) Field of Classification Search
CPC ..... H01F 1/0576; H01F 41/0253; H01F 41/0266; H01F 7/02
USPC ..... 335/296–299, 302–330; 148/100, 101, 148/121
See application file for complete search history.

(56) References Cited

U.S. PATENT DOCUMENTS 4,881,985 A * 11/1989 Brewer et al. ..... 148/103
5,009,706 A * 4/1991 Sakamoto et al. ..... 75/244
(Continued)

FOREIGN PATENT DOCUMENTS

EP 0 133 758 A 3/1985
JP 2-94603 4/1990
(Continued)

OTHER PUBLICATIONS

Written Opinion of the International Searching Authority in International Application No. PCT/IB2012/000321 (Mailing Date: May 22, 2012).

*Primary Examiner* — Bernard Rojas
(74) *Attorney, Agent, or Firm* — Finnegan, Henderson, Farabow, Garrett & Dunner, LLP

(57) ABSTRACT

A method of producing an R-T-B rare earth magnet that include forming an R-T-B (R: rare-earth element, T: Fe, or Fe and partially Co that substitutes for part of Fe) rare earth alloy powder into a compact and performing hot working on the compact, wherein the hot working is performed in a direction that is different from the direction in which the forming was performed.

10 Claims, 18 Drawing Sheets

(51) Int. Cl.

| | |
|---|---|
| ***H01F 1/057*** | (2006.01) |
| ***C22C 38/00*** | (2006.01) |
| ***C22C 38/10*** | (2006.01) |
| ***C22C 1/00*** | (2006.01) |
| ***B22F 3/14*** | (2006.01) |

(56) References Cited

U.S. PATENT DOCUMENTS

| | | | | |
|---|---|---|---|---|
| 5,026,419 | A * | 6/1991 | Iwasaki et al. | 75/254 |
| 5,162,063 | A * | 11/1992 | Shinoda et al. | 148/101 |
| 5,433,795 | A * | 7/1995 | Panchanathan et al. | 148/101 |
| 7,815,749 | B2 * | 10/2010 | Yokoyama | 148/121 |
| 8,002,906 | B2 * | 8/2011 | Suzuki et al. | 148/302 |
| 2002/0043302 | A1 * | 4/2002 | Ono et al. | 148/302 |
| 2010/0321139 | A1 | 12/2010 | Shoji et al. | |
| 2012/0306308 | A1 * | 12/2012 | Nishiuchi et al. | 310/156.01 |

FOREIGN PATENT DOCUMENTS

| | | |
|---|---|---|
| JP | 7-169632 | 7/1995 |
| JP | 2693601 | 9/1997 |
| JP | 2011-3662 | 1/2011 |

* cited by examiner (×100)

METHOD PRODUCING RARE EARTH MAGNET

CROSS-REFERENCE TO RELATED APPLICATIONS

This application is a national phase application of International Application No. PCT/IB2012/000321, filed Feb. 22, 2012, and claims the priority of Japanese Application No. 2011-037320, filed Feb. 23, 2011, the content of both of which is incorporated herein by reference.

BACKGROUND OF THE INVENTION

1. Field of the Invention

The invention relates to a method of producing a rare earth magnet using hot working. "Hot working" has substantially the same meaning as "hot plastic working".

2. Description of Related Art

Rare earth magnets, as typified by neodymium magnet ($Nd_2Fe_{14}B$), have a very high magnetic flux density and are used for various applications as strong permanent magnets.

It is known that a neodymium magnet has higher coercivity as its crystal grain size is smaller. Thus, a magnetic powder (powder particle size: approximately 100 μm), which is a nano-polycrystalline material with a crystal grain size of approximately 50 to 100 nm, is filled in a mold and hot press working is performed to form a bulk body with the nano-polycrystalline structure maintained. In this state, however, the individual nano-crystal grains are randomly oriented and high magnetization cannot be obtained. Thus, hot working for crystal alignment should be performed to induce crystal gliding to align the orientation of the crystal grains.

For example, Japanese Patent No. 2693601 discloses a method of producing a rare earth magnet by performing cold molding, hot press consolidation, and hot working on an R—Fe—B alloy (wherein R represents at least one rare-earth element including Y) powder that is obtained by melt quenching. However, there is a limit to the improvement of magnetization because there is a limit to the resulting degree of crystal orientation.

SUMMARY OF THE INVENTION

The invention provides a method of producing a rare earth magnet that provides the resulting rare earth magnet with high magnetization and ensures its high coercivity by hot working.

A first aspect of the invention is a method of producing an R-T-B rare earth magnet that include forming an R-T-B rare earth alloy (R: rare-earth element, T: Fe, or Fe and partially Co that substitutes for part of Fe) powder into a compact and performing hot working on the compact, characterized in that the hot working is performed in a direction that is different from the direction in which the forming was performed.

In the method according to the above first aspect, the hot working may be performed in a direction that is different by 60° or more from the direction in which the forming was performed. In the method according to the above first aspect, the hot working may be performed in a direction that is different by substantially 90° from the direction in which the forming was performed.

In the method according to the above first aspect, the hot working may be performed with a reduction ratio of 60% or higher. In the method according to the above first aspect, the hot working may be performed with a reduction ratio of 80% or higher.

In the method according to the above first aspect, prior to the hot working, preliminary hot working is performed in a direction that is different from the direction in which the hot working will be performed. In the method according to the above first aspect, the preliminary hot working may be performed with a reduction ratio within a range between 10% and 45% inclusive. In the method according to the above first aspect, it is most preferable that the preliminary hot working be performed with a reduction ratio of substantially 30%.

In the method according to the above first aspect, the preliminary hot working may be hot pressing. In the method according to the above first aspect, the hot working may be hot pressing.

A second aspect of the invention is an R-T-B rare earth magnet that is produced by the method according to the above first aspect.

The present inventors conducted close examination as described below.

As a typical example, materials of a rare earth magnet were mixed in amounts that provided an alloy composition (% by mass) 31Nd-3Co-1B-0.4Ga-bal.Fe, and the mixture was melted in an Ar atmosphere. The melt was quenched by injecting it from an orifice onto a rotating roll (chromium-plated copper roll) to form alloy flakes. The alloy flakes were pulverized with a cutter mill and sieved in an Ar atmosphere to obtain a rare earth alloy powder with a particle size of 2 mm or less (average particle size: 100 μm). The powder particles had a crystal grain diameter of approximately 100 nm and an oxygen content of 800 ppm.

The powder was filled in a cemented carbide alloy die with a ϕ10 mm×height 17 mm capacity, and the top and bottom of the die were sealed with cemented carbide alloy punches.

The die/punch assembly was set in a vacuum chamber, and the vacuum chamber was decompressed to $10^{-2}$ Pa. The die/punch assembly was then heated with high-frequency coils, and press working was performed at 100 MPa immediately after the temperature reached 600° C. The die/punch assembly was held still for 30 seconds after the press working, and a bulk body was removed from the die/punch assembly. The bulk body had a height of 10 mm (and a diameter of ϕ10 mm).

The bulk body was placed in a ϕ20 mm cemented carbide alloy die. The die/punch assembly was set in a vacuum chamber, and the vacuum chamber was decompressed to $10^{-2}$ Pa. The die/punch assembly was then heated with high-frequency coils, and hot upsetting was performed with a reduction ratio of 20, 40, 60, or 80% immediately after the temperature reached 720° C.

A 2 mm□ test piece was cut from a central portion of each sample and the magnetic properties of the samples were measured using a vibrating sample magnetometer (VSM). The result is shown in FIGS. 1A and 1B.

First, as shown in FIG. 1A, when the reduction ratio in the hot working is 60% or higher, alignment levels off and improvement in magnetization also levels off accordingly. In addition, as shown in FIG. 1B, when hot working is performed, the degree of orientation is improved and the magnetization increases, whereas the coercivity significantly decreases.

<Analysis of Problems of Prior Arts>

The present inventors conducted close studies of the reasons for the conventional problems (1) and (2) below: (1) Improvement in magnetization levels off when the reduction ratio in hot working is increased above 60%. (2) The coercivity significantly decreases even when the magnetization is improved by hot working.

(Reason for Problem (1))

Quenched flakes that are suitable for a magnet generally have a thickness of approximately 20 μm, and turn into flat particles with a diameter of approximately 100 to 200 μm as shown in the photograph of FIG. 2 when pulverized. When the particles are heated and compressed in a mold for press molding and sintering, the particles are fixed in a state where the particles are stacked in their thickness direction according to the flat shape of the particles as schematically shown in FIG. 3A. Then, the compact is subjected to hot working with the flat particles maintained in the state where they are stacked in their thickness direction as schematically shown in FIG. 3B. It should be noted that, as shown in FIGS. 3A(A) and 3A(B), the crystal grains that are represented by rectangles in FIG. 3A(A) are secondary crystal grains that consist of aggregations of actual crystal grains (primary crystal grains) that are represented by smaller rectangles in FIG. 3A(B). The secondary crystal grains alone are shown in FIG. 3B.

In addition, as a result of close observation by the present inventors, the following mechanism was found.

The surfaces of the flat powder particles that are shown in FIGS. 3A and 3B are covered with a thin layer of an Nd-rich phase or an oxide thereof as shown in a cross-sectional scanning electron microscope (SEM) image (a) and an enlarged image thereof (b), and an Nd map (c) and an O map (d) of an electron probe microanalysis (EPMA) image in FIG. 4. It was found that in a case where a strain is applied to the crystal by hot working, when the reduction ratio is high, the thin layer causes the powder particles to glide and the energy that is applied by the hot working is absorbed and cannot contribute to the strain deformation of the crystal effectively.

(Reason for Problem (2))

Magnets for hybrid vehicle (HV) motors are required to have a magnetization (residual magnetization) of 1.2 T or higher, preferably 1.35 T or higher. To achieve the magnetization, a reduction ratio of 60% or higher in hot working is necessary. A microstructure after hot working with a reduction ratio of 60% has a very high crystal grain flatness as shown in a transmission electron microscope (TEM) photograph of FIG. 5. Thus, the demagnetizing field that is created by the crystal itself is so strong that magnetization reversal tends to occur as compared to isotropic crystal grains (with an aspect ratio of 1), resulting in lower coercivity.

In addition, the fact that the magnetic decoupling effect of the crystal grain boundaries is reduced because adjacent crystal grains are apparently bound to each other during the hot working and the effect of the interfaces between the particles as domain walls is lowered, is another factor for decrease in coercivity.

Based on the above two reasons, the invention solves the two problems: (1) to achieve a high degree of improvement in magnetization that is consistent with a high reduction ratio by hot working, and (2) to achieve improvement in magnetization and ensure high coercivity by hot working.

According to the method of the invention, because hot working is performed in a direction that is different from the forming direction, the mechanism that is described in detail later (1) prevents the quench flakes from gliding along their surfaces and enables the energy that is applied by hot working to contribute to strain deformation of crystal grains effectively, whereby the degree of orientation improves in proportion to the reduction ratio in the hot working, and especially, the magnetization is improved even when reduction ratio is 60% or higher, and (2) prevents flattening of crystal grains and reduces apparent binding between crystal grains, thereby ensuring high coercivity.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1A:
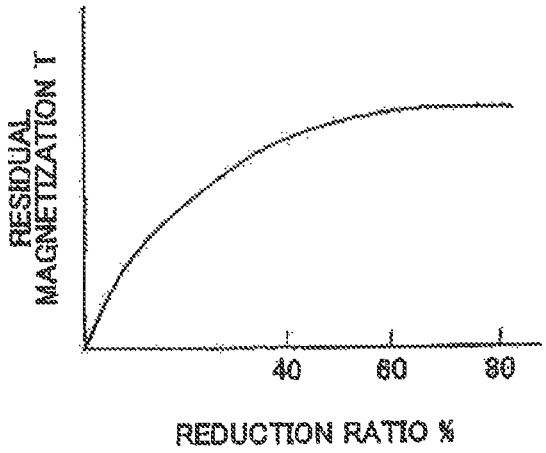
FIG. 1A shows the change in magnetization (residual magnetization) depending on the reduction ratio in 31Nd-3Co-1B-0.4Ga—Fe rare earth magnets that are produced by a conventional method.
Figure 1B:
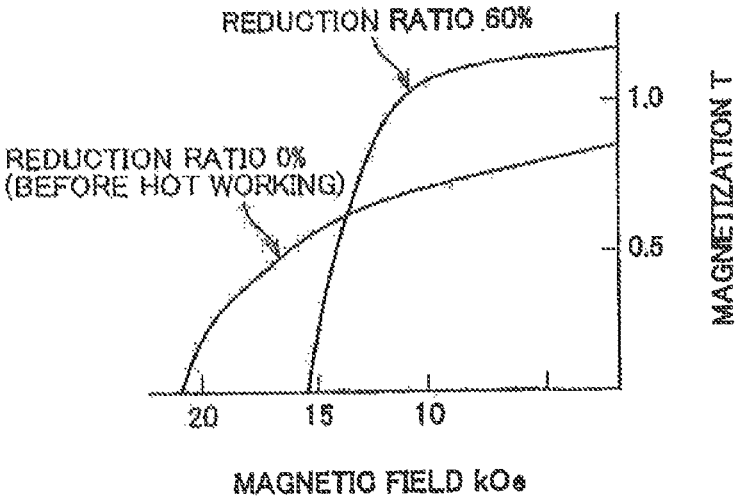
FIG. 1B shows magnetization curves corresponding to two reduction ratios of 31Nd-3Co-1B-0.4Ga—Fe rare earth magnets that are produced by a conventional method.
Figure 2:
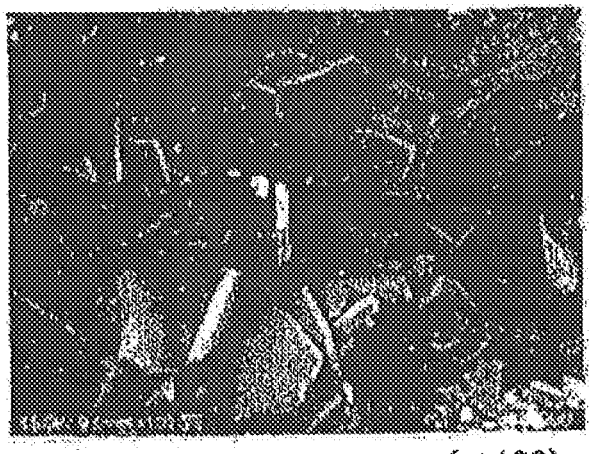
FIG. 2 is an SEM photograph that shows the appearance shape of flat powder particles of pulverized quenched flakes as a material of the rare earth magnets of FIGS. 1A and 1B.
Figure 3A:
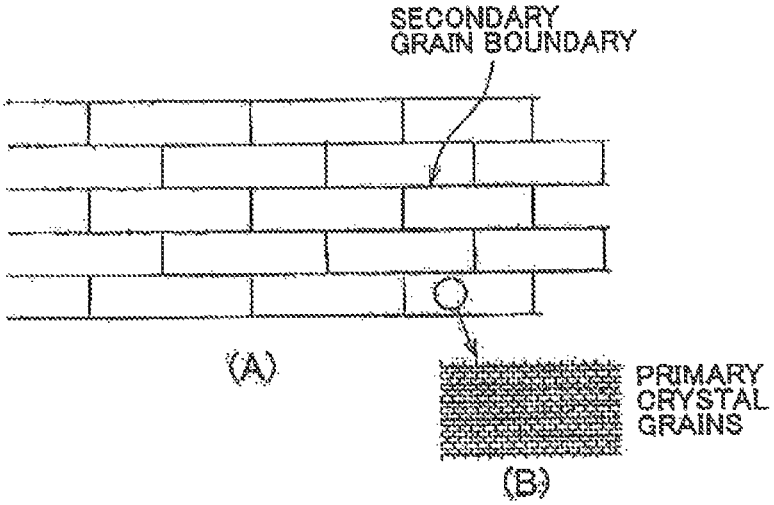
FIG. 3A is a schematic diagram that illustrates (A) the crystal grain structure (secondary crystal grain structure) and (B) primary crystal grain structure after the formation of the pulverized quenched flakes as flat powder particles during the process of production of the rare earth magnet of FIGS. 1A and 1B.
Figure 3B:
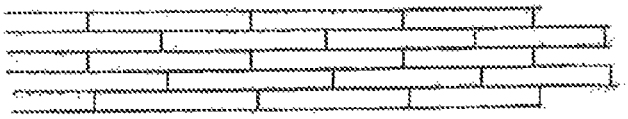
FIG. 3B is a schematic diagram that illustrates the crystal grain structure (secondary crystal grain structure) after hot working during the process of production of the rare earth magnet of FIGS. 1A and 1B.
Figure 4:
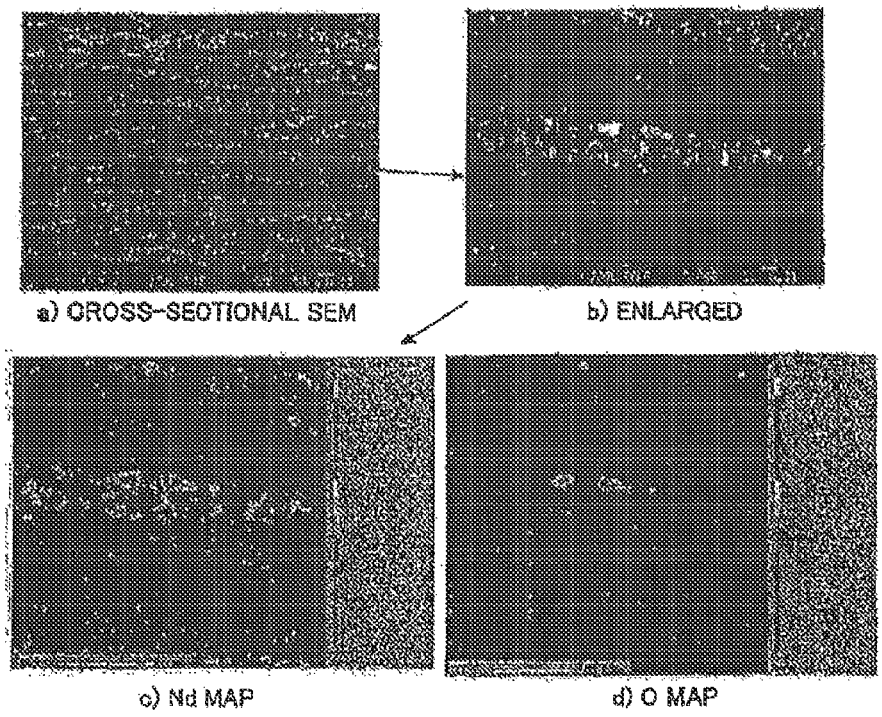
FIG. 4 shows (a) an SEM image of a cross-section of a compact in which the flat powder particles that are shown in FIG. 3A are fixedly stacked and (b) an enlarged image thereof, and (c) an Nd map and (d) an O map of an EPMA image of the compact.
Figure 5:
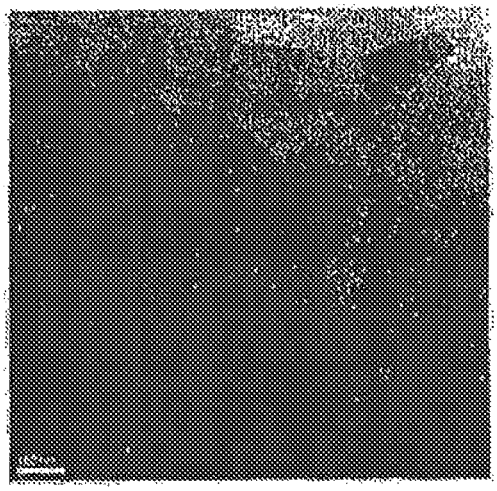
FIG. 5 is a TEM image of a microstructure that is shown in FIG. 3B, which was subjected to hot working with a reduction ratio of 60%.
Figure 6A:
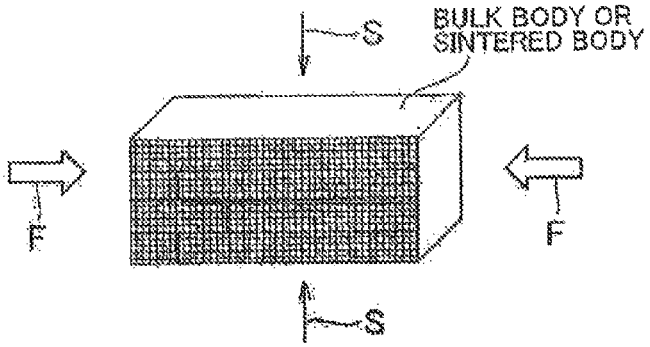
FIGS. 6A to 6C are schematic diagrams that illustrate the crystal grain structure that is obtained by a hot working method according to the invention in comparison with a conventional method.
Figure 6B:
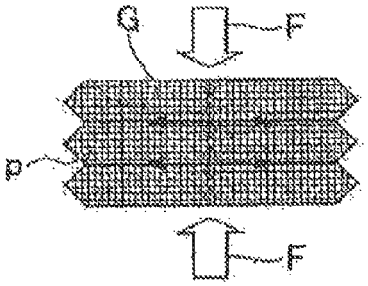
Figure 6C:
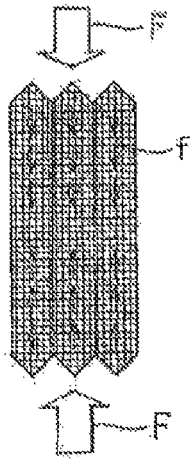

FIGS. 6A to 6C schematically illustrate the hot working method of the invention. As shown in FIG. 6A, the hot working is performed in a direction F, which is different from the forming direction S. In the illustrated example, the hot working is performed in a direction F, which is different by 90° from the forming direction S.

FIG. 6B shows a conventional hot working direction for comparison. The hot working is performed in a direction F, which is the same as the forming direction S that is shown in FIG. 6A. In this case, flat particles p have a glide G along their contact surfaces and the energy of the hot working F cannot contribute to the plastic deformation f of the crystal effectively. In particular, the degree of orientation of the crystal cannot be improved when the reduction ratio is 60% or higher.

On the contrary, in the invention, the hot working is performed in a direction F, which is different from the forming direction S. Thus, the flat particles do not have a glide G along their surfaces as shown in FIG. 6C and the energy of the hot working F effectively contributes to the plastic deformation f of the crystal. In particular, the degree of orientation of the crystal can be further improved even when the reduction ratio is 60% or higher, and a nanoscale fine crystal grain diameter can be achieved. As a result, the magnetization and coercivity are improved simultaneously.

In the invention, the forming method is not specifically limited, and any method of forming a green compact in powder metallurgy may be used. Hot press molding may be used to carry out sintering simultaneously or SPS sintering may be used to obtain a bulk body as a sintered body.

In the invention, the method for the hot working is not specifically limited. Any general hot working method for metals, such as hot forging or hot rolling, may be used.

In a preferred embodiment, the hot working is performed in a direction that is different by 60° or more from the forming direction. When hot working is performed in a direction that is different by 60° or more from the forming direction, the value of magnetization (residual magnetization) increases rapidly. Most preferably, the hot working is performed in a direction that is different by 90° from the forming direction to obtain the maximum magnetization.

In a preferred embodiment, the hot working is performed with a reduction ratio of 60% or higher. When the reduction ratio is 60% or higher, the magnetization, which levels off in a conventional process, improves significantly.

In a preferred embodiment, preliminary hot working is performed in a direction that is different from the direction in which the hot working will be performed prior to the hot working. In general, preliminary hot working is performed with a reduction ratio that is lower than that with which the hot working is performed. Although there is no need to adhere to the following rules, the preliminary hot working is typically performed with a reduction ratio of lower than 60% and the hot working is performed with a reduction ratio of 60% or higher. While various approaches are available, two typical approaches are schematically shown in FIGS. 7A and 7B.

Figure 7A:
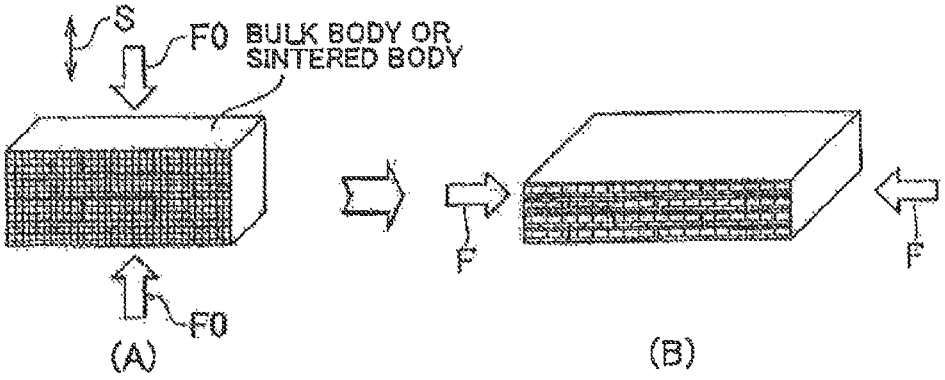
FIGS. 7A and 7B are schematic diagrams that illustrate the crystal grain structures that are obtained by two preferred hot working methods of the invention.

In the approach that is shown in FIG. 7A, (A) preliminary hot working F0 is performed in the same direction as the forming direction S, and then (B) hot working F is performed in a direction that is different from the direction in which the preliminary hot working F0 was performed (in the illustrated example, in a direction at 90° to the direction S).

Figure 7B:
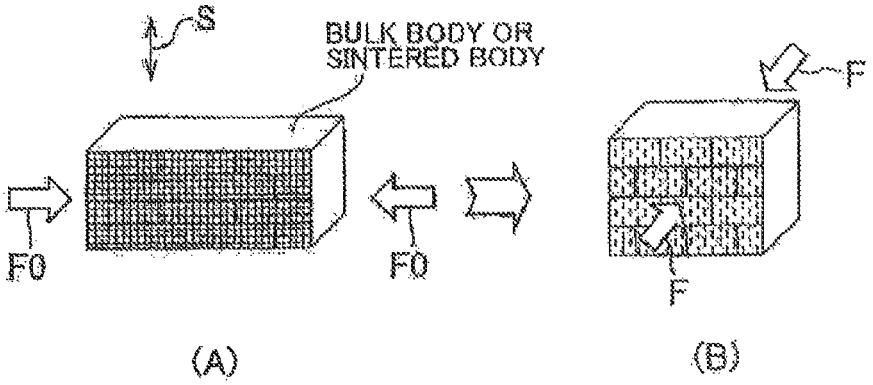

In the approach that is shown in FIG. 7B, (A) preliminary hot working F0 is performed in a direction that is different from the forming direction S (in the illustrated example, in a direction at 90° with respect to the forming direction S), and then (B) hot working F is performed in a direction that is different from the forming direction S and the direction in which the preliminary hot working F0 was performed (in the illustrated example, in a direction at 90° with respect to the direction S and the direction F0). When two hot working steps F0 and F are performed as described above, the coercivity and magnetization can be further improved.

Figure 8:
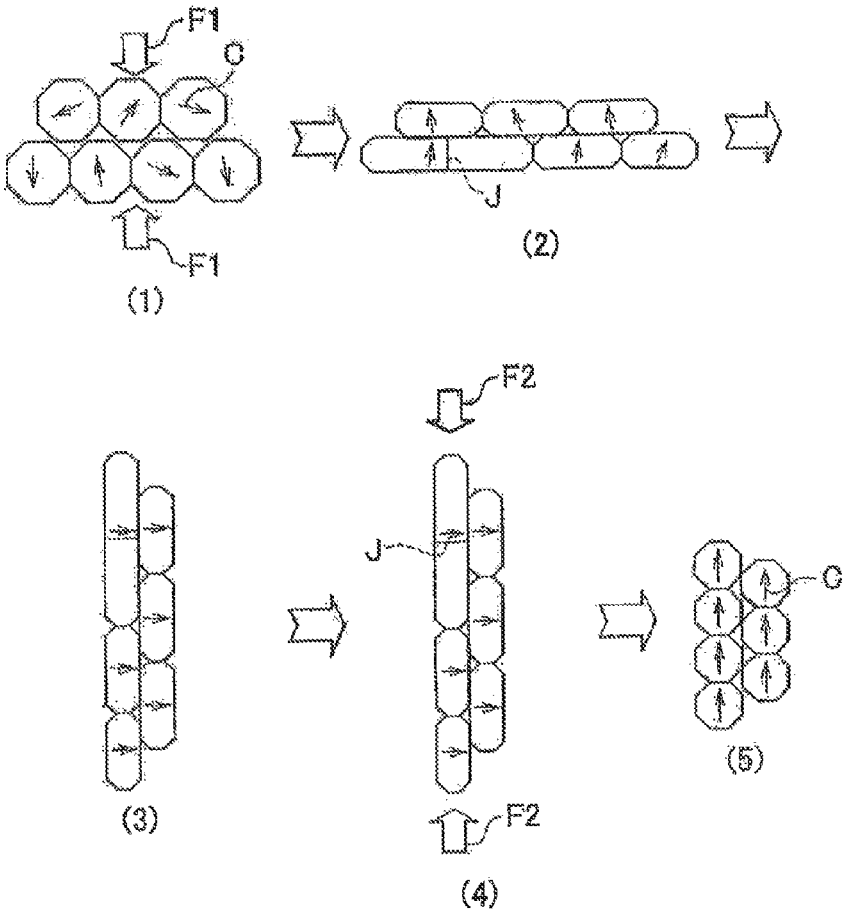
FIG. 8 schematically illustrates the changes in crystal grain structure and easy magnetization axis C that are provided by two hot working steps in a preferred embodiment of the invention.

FIG. 8 schematically illustrates the changes in crystal grain structure and easy magnetization axis C that occur as two hot working steps are performed.

First, as shown in FIG. 8(1), crystal alignment has not substantially occurred immediately after the forming. Thus, the easy magnetization axes C are oriented randomly and the crystal grains have an almost isotropic shape (aspect ratio≈1). When preliminary hot working F1 is performed (in the same direction as the forming direction S or in a direction that is different from the forming direction S) in this state, the crystal grains are flattened and some adjacent crystal grains have apparent binding J as shown in FIG. 8(2). When the apparent binding J occurs, the magnetic decoupling effect of the crystal grain boundary is reduced or lost at the interface J, which leads to a decrease in coercivity of the magnet as a whole.

Then, the material is typically rotated 90° with respect to the forming direction S as shown in FIG. 8(3), and hot working F2 is performed as shown in FIG. 8(4). As a result, the crystal grains, which have been flattened by the preliminary hot working F1, become isotropic (aspect ratio≈1) and the easy magnetization axes C are strongly oriented in the direction in which the hot working F2 was performed as shown in FIG. 8(5). In addition, the apparent biding J is released and the crystal grain boundaries are formed again. In this way, when the hot working F2, in particular, is performed with a high reduction ratio of 60% or higher, high magnetization and high coercivity, which cannot be obtained by a conventional process, can be achieved simultaneously.

<Composition of Rare Earth Alloy>

The composition that is targeted by the invention is an R-T-B rare earth magnet.

R is a rare-earth element, typically at least one of Nd, Pr, Dy, Tb, and Ho, and preferably is Nd, or Nd and partially at least one of Pr, Dy, Tb, and Ho that substitutes for part of Nd. The term "rare-earth element" also includes Di, a mixture of Nd and Pr, and heavy rear earth metals, such as Dy.

In the invention, the content of the rare-earth element R in the rare earth alloy is preferably 27 to 33 wt % from the viewpoint of improvement of both coercivity and magnetization (residual magnetization).

Figure 9:
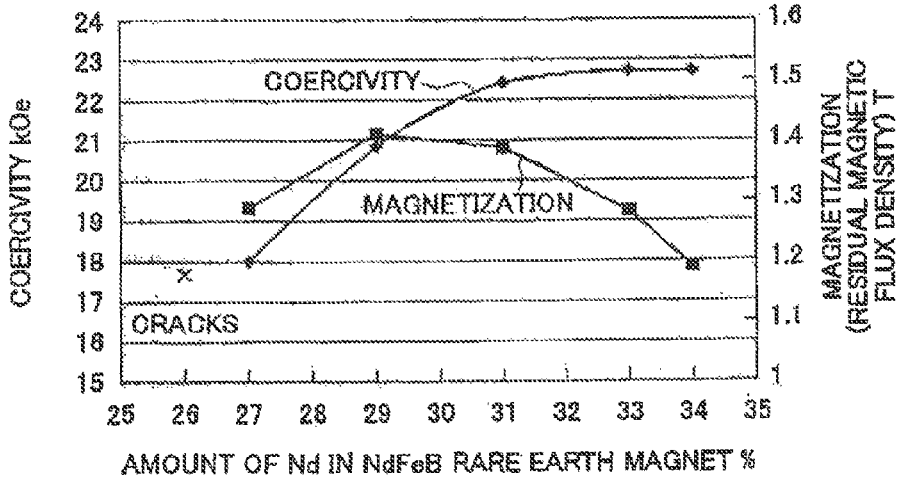
FIG. 9 shows the changes in coercivity and magnetization (residual magnetization) depending on the amount of Nd in an $Nd_2Fe_{14}B$ rare earth alloy as a typical example to which the invention is applied.

FIG. 9 shows the changes in coercivity and magnetization (residual magnetization) depending on the amount of Nd in an $Nd_2Fe_{14}B$ rare earth alloy as a typical example.

When the amount of Nd is less than 27 wt %, the magnetic decoupling effect tends to be insufficient and the basic coercivity decreases. In addition, cracks tend to occur during hot working.

On the other hand, when the amount of Nd is greater than 33 wt %, the percentage of the main phase decreases, resulting in insufficient magnetization.

The rare earth alloy powder that is used in the invention typically has a particle size of approximately 2 mm or smaller, preferably approximately 50 to 500 μm. The pulverization is carried out in an inert gas atmosphere, such as Ar or $N_2$, to prevent oxidation of the powder.

Example 1

Rare earth magnets were produced according to the following procedure and under the following conditions based on the method of the invention, and their magnetic properties were evaluated.

<Preparation of Raw Powder>

Raw materials of a rare earth magnet were mixed in amounts that provided an alloy composition (% by mass) 31Nd-3Co-1B-0.4Ga-bal.Fe, and the mixture was melted in an Ar atmosphere. The melt was quenched by injecting it from an orifice onto a rotating roll (chromium-plated copper roll) to form alloy flakes. The alloy flakes were pulverized with a cutter mill and sieved in an Ar atmosphere to obtain a rare earth alloy powder W with a particle size of 2 mm or less (average particle size: 100 μm). The powder particles had an average crystal grain diameter of approximately 100 to 200 nm and an oxygen content of 800 ppm.

Description is hereinafter made with reference to the FIG. 10.

<Forming (Formation of Bulk Body)>

Figure 10:
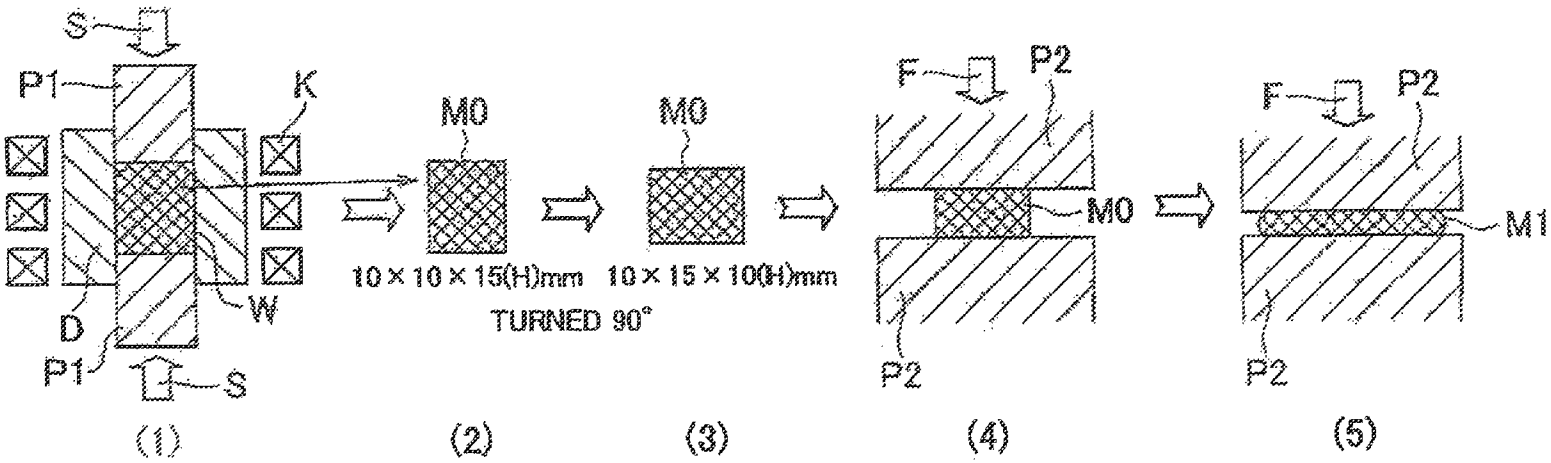
FIG. 10 schematically illustrates the process of forming→changing the processing direction→hot working in Example 1 of the invention.

The powder W was filled into a cemented carbide alloy die D1 with a 10×10×30 (H) mm capacity, and the top and bottom of the die were sealed with cemented carbide alloy punches P1 as shown in FIG. 10(1).

The die/punch assembly was set in a vacuum chamber, and the vacuum chamber was decompressed to $10^{-2}$ Pa. The die/punch assembly was then heated with high-frequency coils K, and press working S was performed at 100 MPa immediately after the temperature reached 600° C. (strain rate: 1/s). The die/punch assembly was held still for 30 seconds after the press working, and a bulk body M0 (10×10×15 (H) mm) was removed from the die/punch assembly as shown in FIG. 10(2).

<Hot Working>

The bulk body M0 was turned 90° with respect to the direction in which the press working S was performed as shown in FIG. 10(3), and was set between other ϕ30 mm cemented carbide alloy punches P2. The die/punch assembly was placed in the chamber as shown in FIG. 10(4), and the chamber was decompressed to $10^{-2}$ Pa. The die/punch assembly was heated with the high-frequency coils, and hot upsetting F was performed with a reduction ratio of 80% immediately after the temperature reached 750° C. to obtain a final compact M1 (FIGS. 10(4) to 10(5)).

<Strain-Removing Heat Treatment>

After the hot working, a strain-removing heat treatment was performed in a vacuum ($10^{-4}$ Pa) at 600° C. for 60 minutes.

<Magnetic Measurement>

A 2 mm□ test piece was cut from a central portion of the obtained sample and its magnetic properties were measured using a vibrating sample magnetometer (VSM).

(Consideration of Optimum Hot Working Direction)

Figure 11:
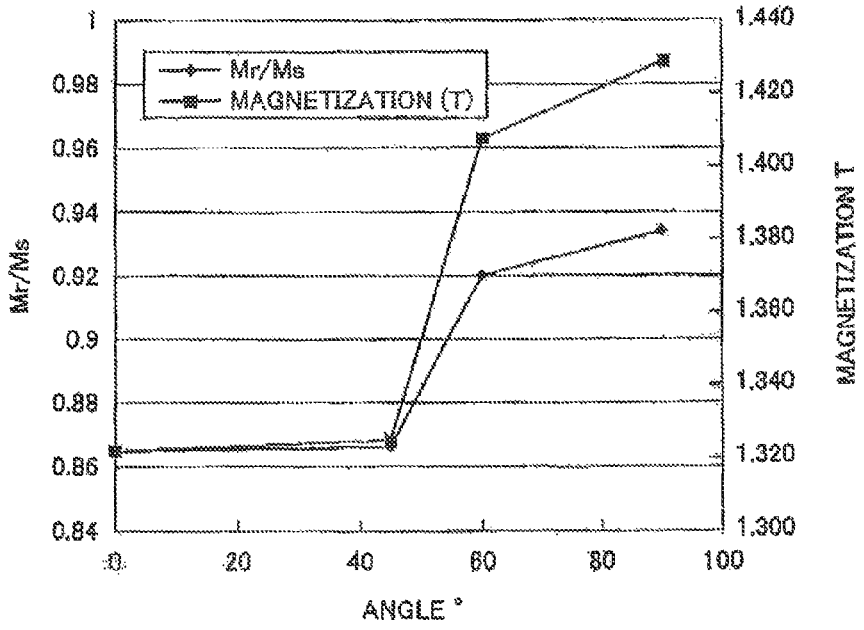
FIG. 11 shows the changes in degree of orientation (Mr/Ms) and magnetization when the inclination angle of the material was changed in Example 1 of the invention.

FIG. 11 shows the results of measurement of magnetization when the angle with respect to the direction of the press working S was changed to 0, 45°, 60° and 90°.

It can be understood that the intensity of magnetization remains almost unchanged when the angle is between 0° and 45° but rapidly increases when the angle exceeds 45°, and that a high value greater than 1.4 T is obtained when the angle is 60° or greater and the magnetization is highest when the angle is 90°. It is, therefore, especially preferred that the hot working is performed in a direction that is different by 60° or more from the forming direction S. Most preferably, the hot working is performed in a direction that is different by 90° from the forming direction S to obtain the maximum magnetization. In all the following examples, the change in the working direction was 90°.

Comparative Example 1

A rare earth magnet was produced according to the following procedure and under the following conditions based on a conventional method, and its magnetic properties were evaluated.

The same procedure from <Preparation of raw powder> to <Forming (formation of bulk body)> as in Example 1 was followed to obtain a bulk body.

According to a conventional method, the steps <Hot working>, <Strain-removing heat treatment> and <magnetic measurement> were carried out in the same manner as in Example 1 except that the orientation of the bulk body M was unchanged.

Example 2

Rare earth magnets were produced according to the following procedure and under the following conditions based on the method according to a preferred embodiment of the invention, and their magnetic properties were evaluated.

The same procedure from <Preparation of raw powder> to <Forming (formation of bulk body)> as in Example 1 was followed to obtain a bulk body.

Description is hereinafter made with reference to FIG. 12.

<Preliminary Hot Working>

The bulk body M0, which was formed as described above and as shown in FIG. 12(1), was set between ϕ30 mm cemented carbide alloy punches P2 with its orientation unchanged as shown in FIG. 12(2). The die/punch assembly was placed in the chamber, and the chamber was decompressed to $10^{-2}$ Pa. The die/punch assembly was heated with the high-frequency coils, and hot upsetting F was performed with a reduction ratio of 10, 30, 45, 60, or 80% immediately after the temperature reached 700° C. to obtain a preliminarily compact M1 (FIG. 12(3)).

Figure 12:
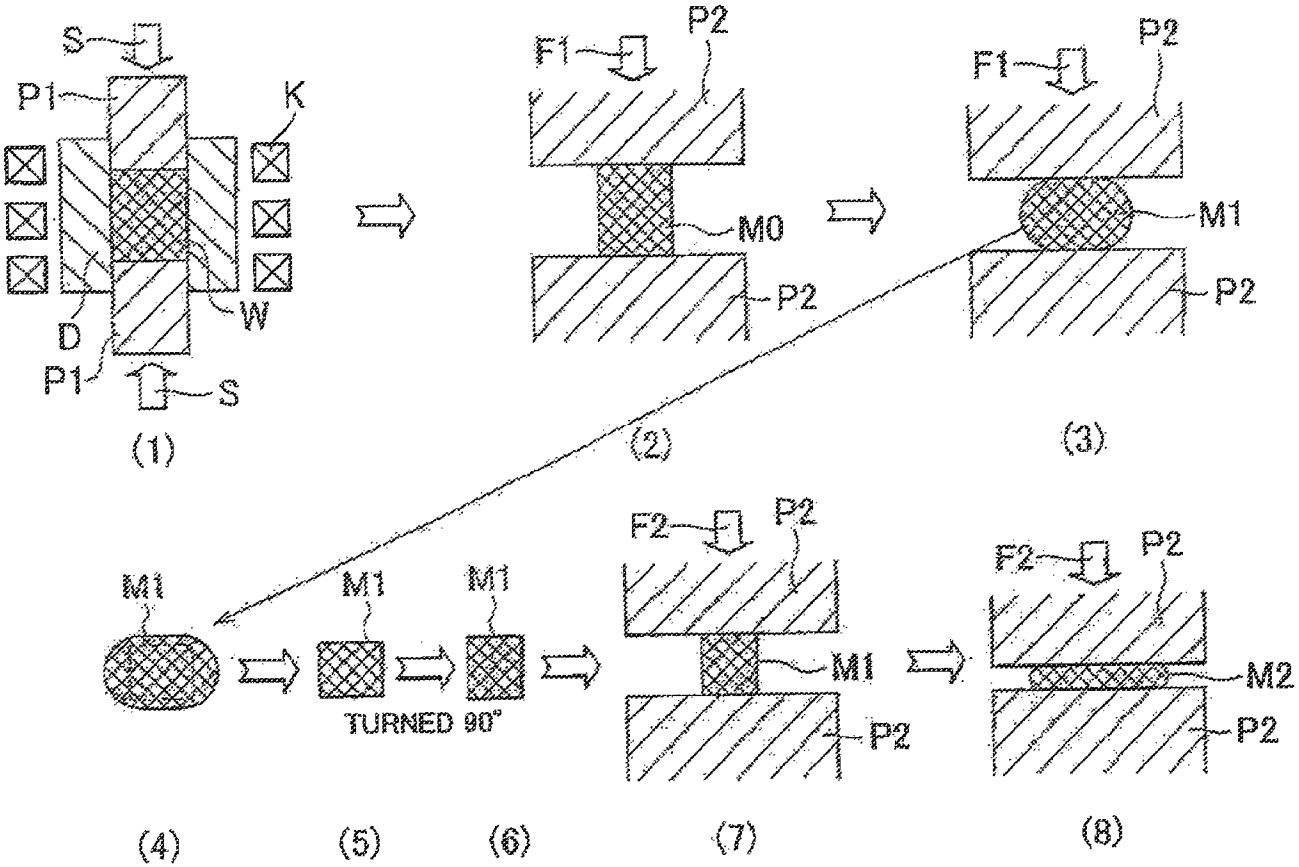
FIG. 12 schematically illustrates the process of forming→preliminary hot working→changing the processing direction→hot working in Example 2 of the invention.

As shown in FIGS. 12(4) to 2(5), the preliminarily compact M1 was machined to a 9×9×9 mm shape for the subsequent hot working.

<Hot Working>

The machined preliminarily compact M1 was turned 90° with respect to the direction in which the press working S was performed as shown in FIG. 12(6) and set between ϕ30 mm cemented carbide alloy punches P2 as shown in FIG. 12(7). The die/punch assembly was placed in the chamber, and the chamber was decompressed to $10^{-2}$ Pa. The die/punch assembly was heated with the high-frequency coils, and hot upsetting F2 was performed with a reduction ratio of 30, 45, 60, or 80% immediately after the temperature reached 750° C. to obtain a final compact M2 (FIG. 12(8)).

The steps <Strain-removing heat treatment> and <Magnetic measurement> were carried out in the same manner as in Example 1.

Comparative Example 2

A rare earth magnet was produced and magnetic measurement was performed in the same manner as in Comparative Example 1 except the followings. For accurate comparison with Example 2, the magnet size was adjusted to 9×9×9 mm. No preliminary hot working was performed.

Example 3

A rare earth magnet was produced in the same manner as in Example 2 based on the method according to a preferred embodiment of the invention, and its magnetic properties were evaluated.

However, the preliminary hot working and hot working were performed as described below. Description is made with reference to FIG. 13.

<Preliminary Hot Working>

Figure 13:
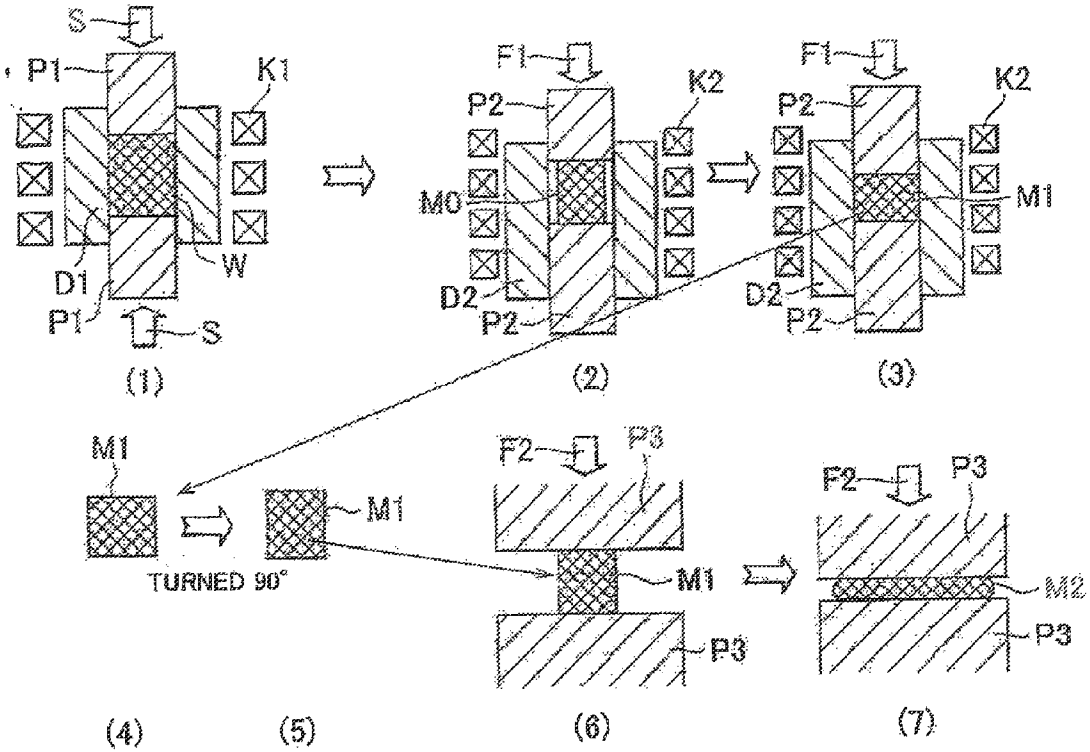
FIG. 13 schematically illustrates the process of forming→preliminary hot working→changing the processing direction→hot working in Example 3 of the invention.

The bulk body M0, which was formed in the same manner as in Example 2 and as shown in FIG. 13(1), was set with its orientation unchanged at the center of a cemented carbide alloy die D2 with a volume of 13×13×20 mm, using cemented carbide alloy punches P2 as shown in FIG. 13(2). The die/punch assembly was placed in the chamber, and the chamber was decompressed to $10^{-2}$ Pa. The die/punch assembly was heated with the high-frequency coils, and hot upsetting F1 was performed until the space in the die D2 was filled immediately after the temperature reached 750° C. to obtain a preliminarily compact M1 (13×13×8.8 (H) mm) (FIG. 13(3)). At this time, the reduction ratio was approximately 40%.

<Hot Working>

The preliminarily compact M1 was turned 90° with respect to the direction in which the press working S was performed as shown in FIGS. 13(4) to 13(5) and set between ϕ30 mm cemented carbide alloy punches P3 as shown in FIG. 13(6). The die/punch assembly was placed in the chamber, and the chamber was decompressed to $10^{-2}$ Pa. The die/punch assembly was heated with the high-frequency coils, and hot upsetting F2 was performed with a reduction ratio of 80% immediately after the temperature reached 750° C. to obtain a final compact M2 (FIG. 13(7)).

The steps <Strain-removing heat treatment> and <Magnetic measurement> were carried out in the same manner as in Example 1.

Comparative Example 3

A rare earth magnet was produced according to the same procedure and under the same conditions as in Example 3, and its magnetic properties were evaluated.

However, no preliminary hot working was performed and hot working was performed as described below.

<Hot Working>

As in the case of Example 3, the bulk body was set between ϕ30 mm cemented carbide alloy punches P3. Then, the chamber was decompressed to $10^{-2}$ Pa, and hot upsetting was performed at 750° C. with a reduction ratio of 80%.

The steps <Strain-removing heat treatment> and <Magnetic measurement> were carried out in the same manner as in Example 1.

Example 4

Rare earth magnets were produced according to the following procedure and under the following conditions based on the method according to a preferred embodiment of the invention, and their magnetic properties were evaluated.

The same procedure from <Preparation of raw powder> to <Forming (formation of bulk body)> as in Example 1 was followed to obtain a bulk body.

Description is hereinafter made with reference to FIG. 14.

<Preliminary Hot Working>

The bulk body M0, which was formed as described above and as shown in FIG. 14(1), was turned 90° with respect to the direction in which the press working S was performed as shown in FIGS. 14(2) to 14(3) and set at the center of a cemented carbide alloy die D2 with a volume of 13×13×20 mm, using cemented carbide alloy punches P2 as shown in FIG. 14(4). The die/punch assembly was placed in the chamber, and the chamber was decompressed to $10^{-2}$ Pa. The die/punch assembly was heated with the high-frequency coils, and hot upsetting F1 was performed until the space in the die D2 was filled immediately after the temperature reached 750° C. to obtain a preliminarily compact M1 (FIG. 14(5)). At this time, the reduction ratio was approximately 40%.

<Hot Working>

Figure 14:
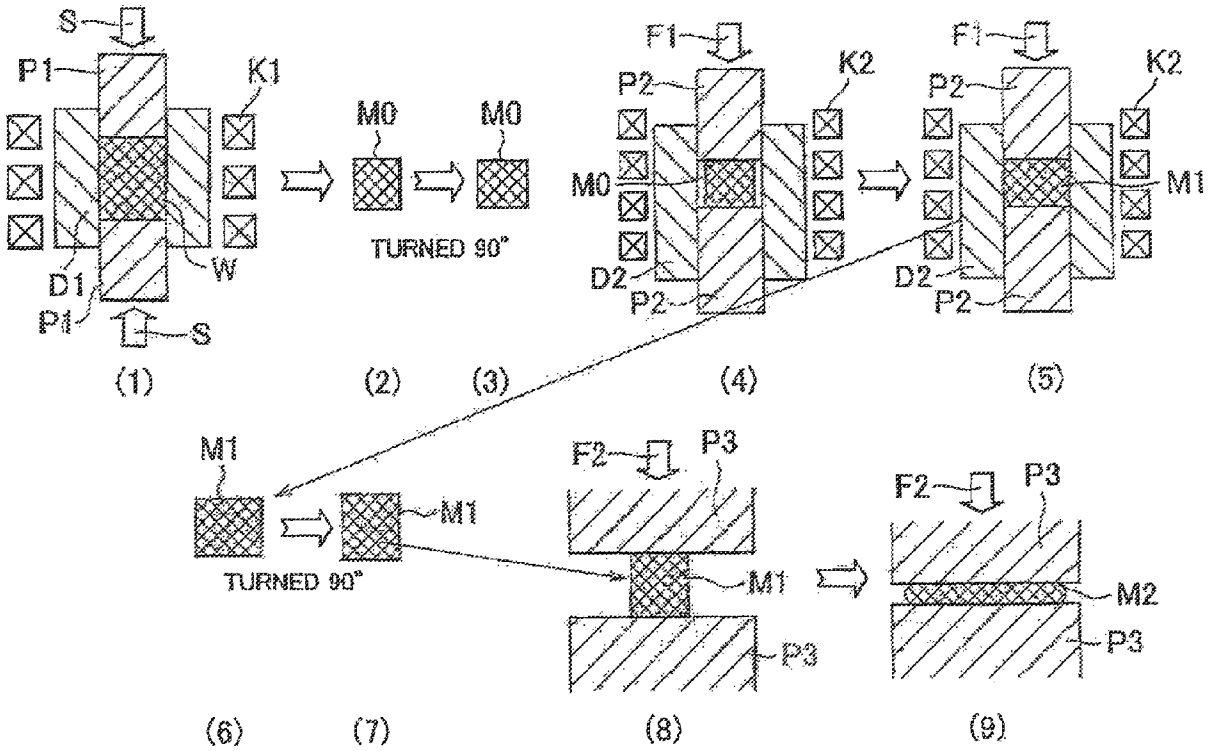
FIG. 14 schematically illustrates the process of forming→changing the processing direction→preliminary hot working→changing the processing direction→hot working in Example 4 of the invention.

The preliminarily compact M1 was turned 90° with respect to the direction in which the press working S and the preliminary hot working F1 were performed as shown in FIGS. 14(6) to 14(7) and set between ϕ30 mm cemented carbide alloy punches P3 as shown in FIG. 14(8). The die/punch assembly was placed in the chamber, and the chamber was decompressed to $10^{-2}$ Pa. The die/punch assembly was heated with the high-frequency coils, and hot upsetting F2 was performed with a reduction ratio of 80% immediately after the temperature reached 750° C. to obtain a final compact M2 as shown in FIG. 14(9).

The steps <Strain-removing heat treatment> and <Magnetic measurement> were carried out in the same manner as in Example 1.

Example 5

Rare earth magnets were produced according to the following procedure and under the following conditions based on the method according to a preferred embodiment of the invention, and their magnetic properties were evaluated.

The step <Preparation of raw powder> was carried out in the same manner as in Example 1 to obtain a raw powder.

The raw powder was filled in a cemented carbide alloy mold with a volume of 15×15×70 (H) mm, and SPS sintering was performed to obtain a 15×15×50 mm bulk body.

Description is hereinafter made with reference to FIG. 15.

<Preliminary Hot Working>

Figure 15:
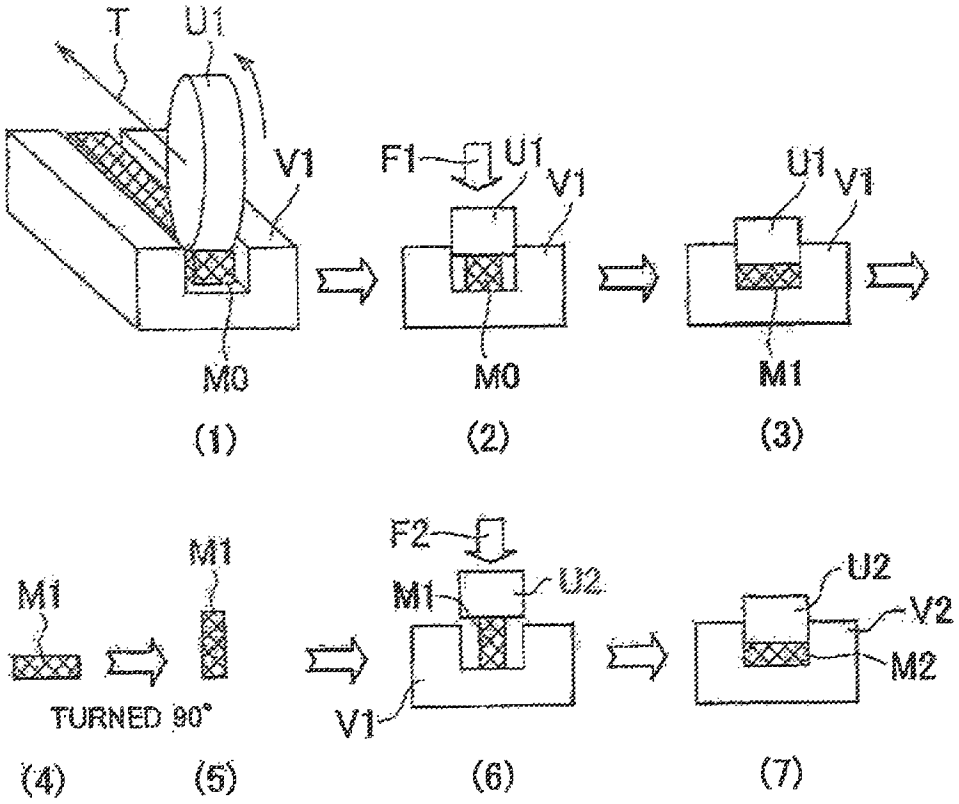
FIG. 15 schematically illustrates the process of preliminary hot working→changing the processing direction→hot working in Example 5 of the invention.

The bulk body M0 was placed in a mold V1 with a 23(W)×23(H) mm cross-section and heated together with the mold V1 to 700° C. by induction heating as shown in FIG. 15(1). Then, the bulk body M0 was rolled by applying a force F1 while a roll U1 was moved in the T-direction as shown in FIG. 15(2) to obtain a preliminarily compact M1 with dimensions of thickness 10 (H) mm×width 23 (W) mm×length 49 (L) mm as shown in FIG. 15(3). The reduction ratio in the preliminary hot working was 33%.

<Hot Working>

The preliminarily compact M1 was turned 90° with respect to the direction of the rolling force F1 as shown in FIGS. 15(4) to 15(5) so that the width direction (23 mm width) became the new thickness direction. The preliminarily compact M1 was heated to 750° C. in a mold V2 with a 50 (W)×30 (H) mm cross-section by induction heating and rolled by applying a force F2 with a roll U2 as shown in FIG. 15(6) to obtain a final compact M2 with dimensions of thickness 3 (H) mm×width 50 (W) mm×length 77 (L) mm as shown in FIG. 15(7). The reduction ratio in the hot working was 70%.

The steps <Strain-removing heat treatment> and <Magnetic measurement> were carried out in the same manner as in Example 1.

Comparative Example 4

A rare earth magnet was produced according to the same procedure and under the same conditions as in Example 5, and its magnetic properties were evaluated.

However, no preliminary hot working was performed and hot working was performed as described below.

<Hot Working>

The bulk body M0 was placed with its orientation unchanged from the state that is shown in FIG. 15(1) in a mold V2 with a 50 (W)×30 (H) mm cross-section as shown in FIG. 15(6) and heated to 750° C. by induction heating. The bulk body M0 was rolled by applying a force F2 with a roll U2 to obtain a final compact M2 as shown in FIG. 15(7). The reduction ratio was 70%.

The steps <Strain-removing heat treatment> and <Magnetic measurement> were carried out in the same manner as in Example 1.

Example 6

Rare earth magnets were produced according to the following procedure and under the following conditions based on the method according to a preferred embodiment of the invention, and their magnetic properties were evaluated.

The same procedure from <Preparation of raw powder> to <Forming (formation of bulk body)> as in Example 5 was followed to obtain a bulk body.

Description is hereinafter made with reference to FIG. 16.

<Preliminary Hot Working>

Figure 16:
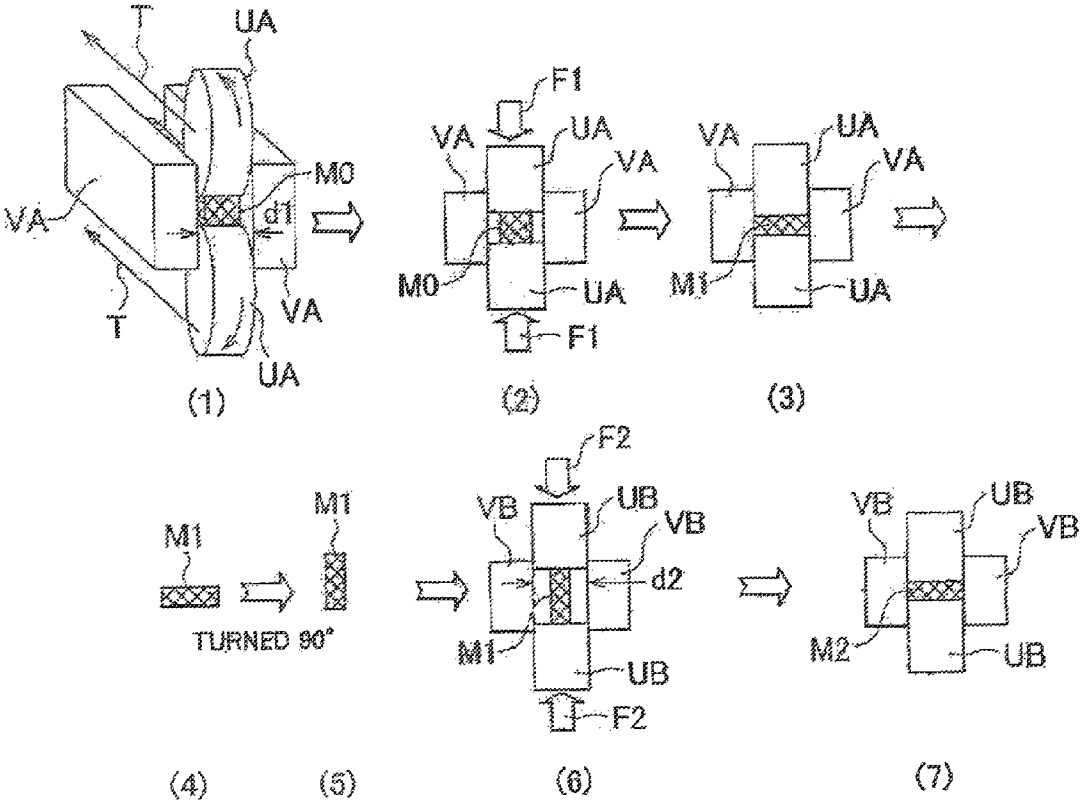
FIG. 16 schematically illustrates the process of preliminary hot working→changing the processing direction→hot working in Example 6 of the invention.

The bulk body M0, which was placed between molds VA that were located at a distance d1 of 23 mm as shown in FIG. 16(1), was heated together with the molds VA to 700° C. by induction heating. Then, the bulk body M0 was rolled by applying a force F1 while a pair of upper and lower rolls UA were moved in the T-direction as shown in FIG. 16(2) to obtain a preliminarily compact M1 with dimensions of thickness 10 (H) mm×width 23 (W) mm×length 50 (L) mm as shown in FIG. 16(3). The reduction ratio in the preliminary hot working was 33%.

<Hot Working>

The preliminarily compact M1 was turned 90° with respect to the direction of the rolling force F1 as shown in FIGS. 16(4) to 16(5) so that the width direction (23 mm width) became the new thickness direction. The preliminarily compact M1 was heated to 750° C. between molds V2 that were located at a distance d2 of 50 mm by induction heating and rolled by applying a force F2 with a pair of upper and lower rolls U2 as shown in FIG. 16(6) to obtain a final compact M2 with dimensions of thickness 3 (H) mm×width 50 (W) mm×length 77 (L) mm as shown in FIG. 16(7).

The reduction ratio in the hot working was 70%.

The steps <Strain-removing heat treatment> and <Magnetic measurement> were carried out in the same manner as in Example 1.

Comparative Example 5

A rare earth magnet was produced according to the same procedure and under the same conditions as in Example 6, and its magnetic properties were evaluated.

However, no preliminary hot working was performed and hot working was performed as described below.

<Hot Working>

The bulk body M0 was placed with its orientation unchanged from the sate that is shown in FIG. 16(1) between molds V2 that were located at a distance d2 of 50 mm as shown in FIG. 16(6) and heated to 750° C. by induction heating. Then, the bulk body M0 was rolled by applying a force F2 with a pair of upper and lower rolls U2 as shown in FIG. 16(6) to obtain a final compact M2 with dimensions of thickness 4.6 (H) mm×width 50 (W) mm×length 50 (L) mm as shown in FIG. 16(7). The reduction ratio in the hot working was 70%.

The steps <Strain-removing heat treatment> and <Magnetic measurement> were carried out in the same manner as in Example 1.

(Evaluation of Magnetic Properties)

Figure 17A:
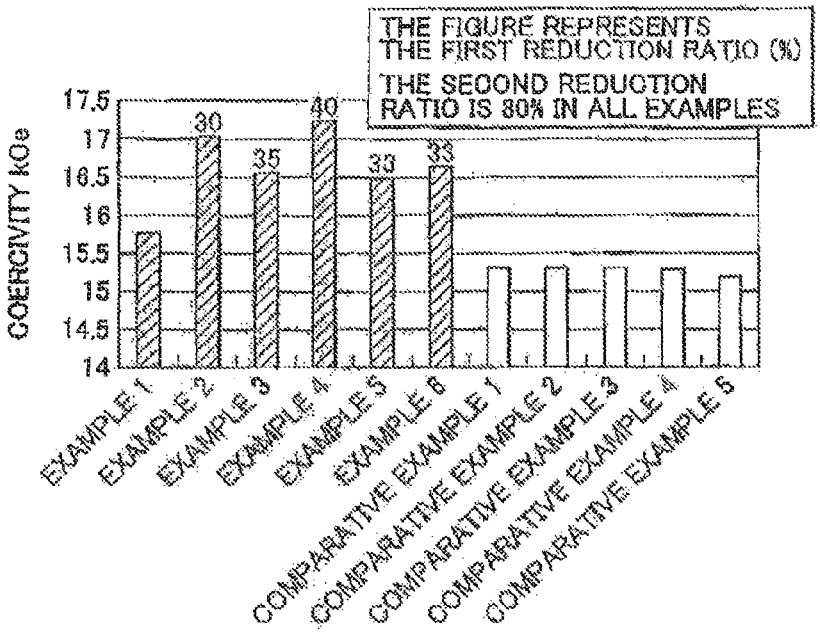
FIG. 17A shows comparison of coercivities in examples of the invention and those in conventional comparative examples.
Figure 17B:
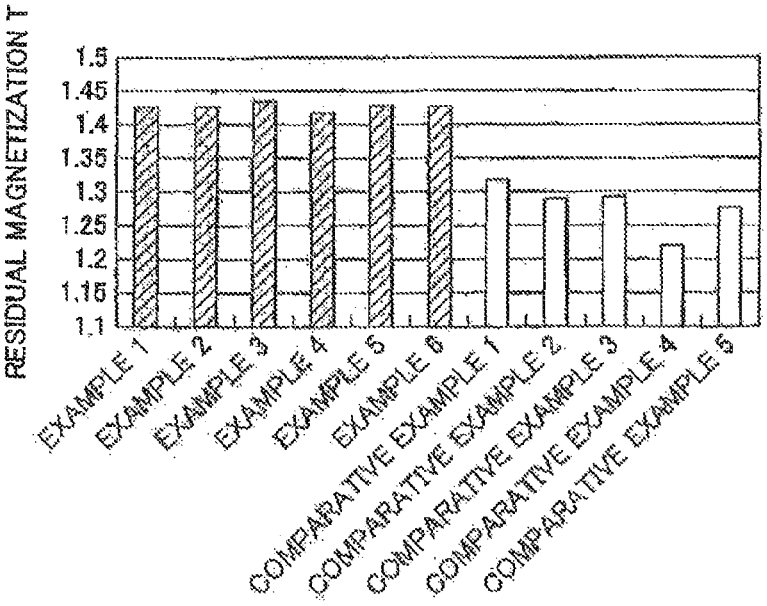
FIG. 17B shows comparison of magnetizations in examples of the invention and those in conventional comparative examples.

FIGS. 17A and 17B show the coercivity and magnetization (residual magnetization) of Examples 1 to 6 and Comparative Examples 1 to 5 for comparison. As to Examples 2 to 6, the reduction ratio (%) in the preliminary hot working (first reduction ratio) is shown above the bar chart of coercivity in FIG. 17A. In all the examples and comparative examples, the reduction ratio in the hot working (second reduction ratio) was 80%.

Both magnetization and coercivity in Examples according to the method of the invention were higher than those in any Comparative Examples. The rate of increase in coercivity in Example 1, in which no preliminary hot working was performed, from those in Comparative Examples was lower than those in Examples 2 to 6, in which preliminary hot working was performed. It is considered that this is because the flatness of the crystal grains was greater in Example 1. The coercivity was highest in Example 4. It is considered that this is because the flat crystal grain structure was converted to an isotropic crystal grain structure because the working direction was changed by 90° both in the preliminary hot working and the hot working.

(Effect of Reduction Ratio in Preliminary Hot Working and Hot Working)

Figure 18A:
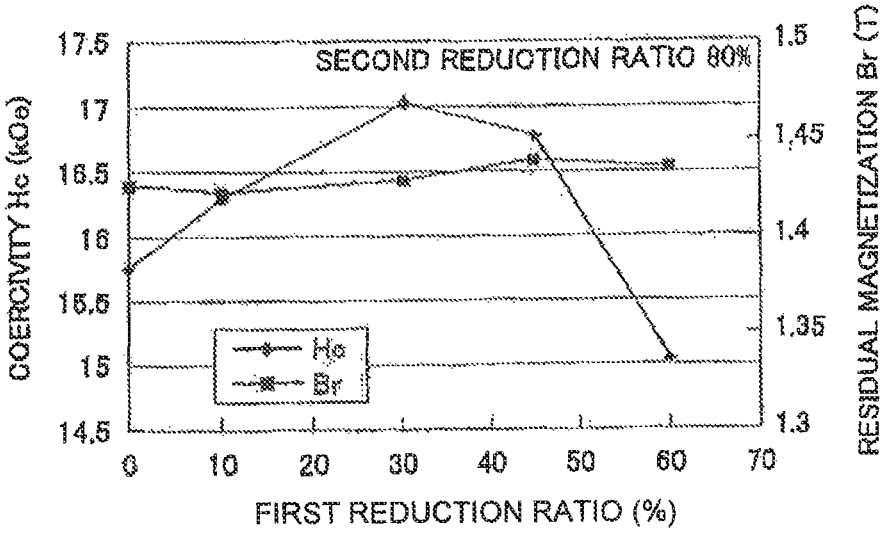
FIG. 18A shows the changes in coercivity and magnetization depending on the reduction ratio in preliminary hot working (first working) in Example 2.
Figure 18B:
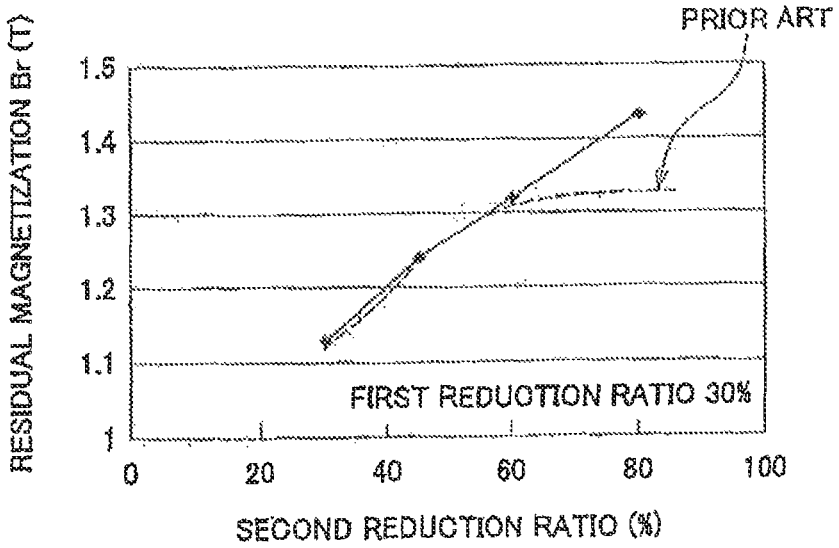
FIG. 18B shows the change in magnetization depending on the reduction ratio in hot working (second working) in Example 2.

FIGS. 18A and 18B show (1) the change in coercivity and magnetization depending on the reduction ratio in the preliminary hot working (first reduction ratio) in Example 2 and (2) the change in magnetization depending on the reduction ratio in the hot working (second reduction ratio) in Example 2, respectively.

The result that is shown in FIG. 18A indicates that the magnetization is almost constant irrespective of the reduction ratio in the preliminary hot working (first reduction ratio) whereas the coercivity starts to decrease when the first reduction ratio exceeds 45% and significantly decreases when the first reduction ratio exceeds 60%. It is considered that this is because strain increases too much.

The result that is shown in FIG. 18B indicates that the magnetization increases almost linearly as the reduction ratio in the hot working (second reduction ratio) increases. The conventional curve in the drawing shows the result when hot working was performed only once and indicates that the improvement in magnetization levels off when the reduction ratio exceeds 60%. According to the invention, high magnetization that was not able to be expected before is obtained by adopting a high reduction ratio of higher than 60%, and high coercivity is also achieved.

According to the invention, there is provided a method of producing a rare earth magnet that provides the resulting rare earth magnet with high magnetization and ensures its high coercivity by hot working.

The invention has been described with reference to example embodiments for illustrative purposes only. It should be understood that the description is not intended to be exhaustive or to limit form of the invention and that the invention may be adapted for use in other systems and applications. The scope of the invention embraces various modifications and equivalent arrangements that may be conceived by one skilled in the art.

The invention claimed is:

1. A method of producing an R-T-B rare earth magnet, comprising:

forming a bulk body which includes an R-T-B rare earth alloy, wherein R: rare-earth element, and T: Fe, or Fe and partially Co that substitutes for part of Fe, and which has a crystal grain structure, by hot press molding; and performing hot working on the bulk body in a direction that is different by an angle within a range between 60° and 90° inclusive from the direction in which the hot press molding was performed, and with a reduction ratio of 60% or higher.

2. The method according to claim 1, wherein the hot working is performed with a reduction ratio of 80% or higher.

3. The method according to claim 1, wherein, prior to the hot working, preliminary hot working is performed to form the bulk body.

4. The method according to claim 3, wherein, the preliminary hot working is hot pressing.

5. The method according to claim 3, wherein the preliminary hot working is performed on the bulk body in a direction that is different from the direction in which the hot working will be performed.

6. The method according to claim 3, wherein the preliminary hot working is performed to the bulk body with a reduction ratio of 40% or less.

7. The method according to claim 1, wherein, the hot working is hot pressing.

8. An R-T-B rare earth magnet produced by the method according to claim 1.

9. The method according to claim 5, wherein, the preliminary hot working is performed on the bulk body in a direction that is different by an angle within a range between 10° and 45° inclusive from the direction in which the hot working will be performed.

10. The method according to claim 9, wherein, the preliminary hot working is performed on the bulk body in a direction that is different by 30° from the direction in which the hot working will be performed.

* * * * *